United States Patent [19]

Kurzböck

[11] Patent Number: 4,640,178

[45] Date of Patent: Feb. 3, 1987

[54] ROPE

[75] Inventor: Erich Kurzböck, Wels, Austria

[73] Assignee: Teufelberger Gesellschaft m.b.H., Austria

[21] Appl. No.: 695,080

[22] Filed: Jan. 25, 1985

[30] Foreign Application Priority Data

Feb. 1, 1984 [AT] Austria ..... 317/84

[51] Int. Cl.[4] ..... D04C 1/12

[52] U.S. Cl. ..... 87/6; 87/1; 87/8

[58] Field of Search ..... 87/1, 5–9, 87/28–30

[56] References Cited

U.S. PATENT DOCUMENTS

| | | | |
|---|---|---|---|
| 2,737,075 | 3/1956 | Poirier et al. | 87/6 |
| 3,030,851 | 4/1962 | Meyer | 87/6 |
| 3,911,785 | 10/1975 | Hood | 87/8 X |
| 4,312,260 | 1/1982 | Morieras | 87/6 X |

FOREIGN PATENT DOCUMENTS

| | | |
|---|---|---|
| 1221926 | 7/1966 | Fed. Rep. of Germany . |
| 1510114 | 1/1970 | Fed. Rep. of Germany . |
| 2455273 | 5/1976 | Fed. Rep. of Germany . |
| 2706562 | 8/1977 | Fed. Rep. of Germany . |
| 2166695 | 8/1973 | France . |

*Primary Examiner*—John Petrakes

*Attorney, Agent, or Firm*—Karl F. Ross; Herbert Dubno

[57] ABSTRACT

A rope comprises of twisted textile fibers in the form of threads, yarns, twines, ply yarns or strands, which fibers consist mainly of synthetic resin, and a reinforcement made of a material which has strength properties differing from those of the textile fibers. The rope is intended for industrial use or as a safety rope, particularly as a climbing rope. In order to increase the life and the abrasion resistance of the rope when it is frequently flexed and to increase the tensile strength of the rope when it extends around a sharp edge, those threads, yarns, twines, ply yarns and strands which consist of twisted textile fibers and are disposed on the outside surface of the rope or of a core of the rope are reinforced by monofilaments of synthetic resin or metal, and/or said threads, yarns, twines, ply yarns or strands of twisted textile fibers are or a core of the rope or the entire rope is provided with a covering consisting of wound or braided monofilaments.

8 Claims, 6 Drawing Figures

FIG. 1
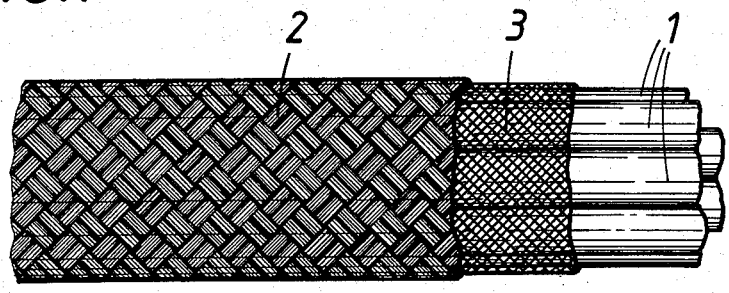
FIG. 2
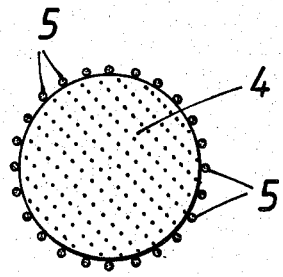
FIG. 3
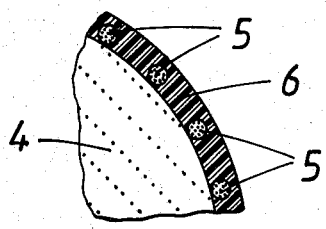
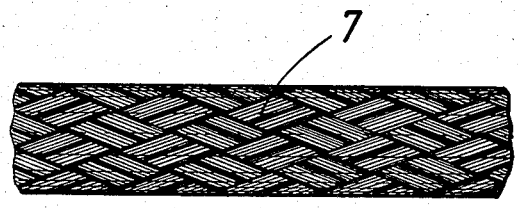
FIG. 4
FIG. 5
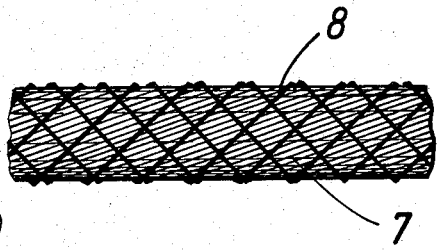
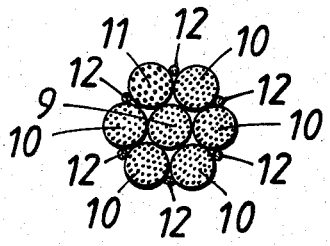
FIG. 6

ROPE

FIELD OF THE INVENTION

This invention relates to a rope which comprises twisted textile threads in the form of elongate textile elements, such as twisted threads, yarns, ply yarns or strands, particularly of synthetic fiber, and which also comprises reinforcing elements consisting of a material which has strength properties differing from those of the textile fibers.

BACKGROUND OF THE INVENTION

Known ropes made of textile fibers consist of twisted or laid strands or of hollow braided ropes or of ropes comprising a core and a sheath (called Kern-Mantel ropes). In ropes of the last-mentioned kind, the core consists of parallel or braided yarns or ply yarns and the mantle consists of a braided tube, which encloses the core.

All known ropes of the kind described hereinbefore can more or less easily be ruptured when they are sharply bent or moved around sharp edges or when they are subjected in operation to high alternating bending stresses, particularly with small radii.

Laid-open German No. 22 22 312 discloses a high-strength rope, which comprises load-carrying threads of synthetic resin, and reinforcing threads which are highly stretchable but have not been stretched or have not been stretched to the highest permissible extent. The reinforcing threads are provided in such quantity and arrangement that in case of an excessive loading of the rope, i.e., when the permissible tensile stress is highly exceeded, the potential energy of the stress is dissipated by the synthetic threads in steps. When the elastic rope is used in the operation of ships, the reinforcing elements are intended to avoid accidents when the rope is ruptured because the ends of the rope would otherwise whip around.

Laid-open German Application No. 24 55 273 discloses a crane rope which consists of a plurality of laid or braided strands and includes elements, such as strands, ply yarns or filaments, which have the same length or almost the same length and are made of a synthetic resin, particularly polyamide, which has a small elongation at break. That rope comprises also internally disposed, shorter elements, such as core strands, core ply yarns or core filaments, which consist of a synthetic resin having a higher elongation at break, such as stretched polyamide, polyester or polypropylene. The rope or each strand thereof may optionally be surrounded by a single sheath layer consisting of flexible synthetic resin, such as polyurethane. Rope elements consisting of different materials are used in such ropes so that the high-strength rope elements having the same length will be subjected to approximately equal stresses when the rope is loaded and the shorter rope elements having a higher elongation will also contribute to the tensile strength of the rope and will not rupture under relatively small loads. The life of the rope is increased by the provision of an external sheath or by an impregnation of the rope with a wear-resisting synthetic resin. In practice, a single sheath layer has the disadvantage that it will not properly adhere to the remainder of the rope and will crack or flake off after a short time of use. Similar disadvantages are encountered in the use of plastic-covered wire ropes, such as are disclosed in German Patent Publication No. 12 21 926.

Laid-open German Application No. 15 10 114 discloses an elastic rope which is intended for safety purposes and comprises a sheath of braided wires and a core which consists of synthetic resin, particularly polyurethane, which has been foamed in the sheath after the latter has been made. In the manufacture of that rope the sheath is preferably coated with a varnish or paint in order to ensure the required resistance to corrosion. Owing to the low strength of its core, such rope has only a low tensile strength and under alternating bending stresses may become unusable by a rupture of the core. For this reason that rope is mainly intended for special purposes, for instance, as a flexible crash guard used instead of a guard rail at the edges of roads.

Laid-open French Application No. 21 66 695 discloses a climbing rope which comprises a core and two sheaths, which surround the core and consist of the same materials and have the same structure. Two sheaths are provided in order to increase the safety and the wear resistance because it is assumed that the other sheath will wear first before the wear of the inner sheath begins. But that design does not result in a higher tensile strength of the rope when the latter is subjected to high tensile stresses while it is bent around a sharp edge.

The ropes which are disclosed in the prior art discussed hereinbefore have been developed for purposes other than those for which the ropes in accordance with the invention is intended.

OBJECTS OF THE INVENTION

The object of the present invention is to provide improved ropes for industrial use and with ropes for safety purposes, particularly climbing ropes.

Ropes for industrial use may consist of hollow braided ropes or of ropes made of laid strands. The invention is particularly concerned with ropes which are intended for industrial use and which are trained around rope pulleys having small radii so that the ropes are subjected to high alternating bending stresses in operation. Even when such ropes are not subjected to high tensile forces, such alternating bending stresses will cause the rope to wear rapidly. A rupture of the rope may necessitate a long downtime of the machine in which the rope is used and said downtime will involve high costs. Investigations made in connection with the invention have shown that the relatively short lives of the known ropes for industrial use are mainly due to the friction of the rope in the grooves of the guiding rollers and rope pulleys and to the frictional contact of the ropes with other surfaces, also to the friction which occurs between fibers in the elements of which the rope is composed because the alternating bending stresses and the movement of the rope along curved paths result in a separation of impregnating materials which have been applied to the fibers. As the ends of hollow braided ropes can be joined more quickly and in a simpler manner, such hollow braided ropes can be repaird more easily or, if they consist of endless ropes, can be repaired or replaced more easily. On the other hand, the known ropes consisting of laid strands have a longer life in most cases.

Ropes for safety purposes, particulary climbing ropes, consist in most cases of a core and a sheath (called Kern-Mantel rope). Such ropes can be made to have such a high strength that in the so-called standard fall test a weight attached to a climbing rope can fall and be caught by the rope numerous times before the rope is damage or undergoes such a large permanent elongation that the rope loses its elasticity. In the standard fall test a weight which corresponds to the average weight of a climber is attached to the rope and is dropped so that the fall of the weight is limited by the rope. If such a test is carried out with a rope which extends around a sharp edge having a radius of curvature below 5 mm and particularly below 1 mm in order to simulate the condition of a climbing rope extending around an edge of a rock, the sudden tensile stress to which the rope is subjected by a suspended weight may cause the rope to rupture or to be damaged to such a degree that it can no longer be used for safety purposes. In that case such damage may arise even when the tensile stress is much lower than the highest tensile stress which is permissible in an unbent rope.

It is another object of the invention to provide a rope which is of the kind described above and which can be used for industrial or safety purposes and which has a much longer life and a much higher tensile strength than known ropes of that kind even when it is subjected in use to alternating bending stresses or is bent with a small radius or around sharp edges.

SUMMARY OF THE INVENTION

In a rope of the kind described hereinabove these objects are accomplished in that those of the elongate textile elements, such as threads, twines, yarns, ply yarns or strands, which are disposed on the outside surface of the rope or on the outside surface of a core of such rope contain reinforcing elements in the form of monofilaments and/or each of said threads, twines, yarns, ply yarns or strands or a core of the rope or the entire rope is provided with a covering consisting of wound or braided monofilaments of a material which has a higher hardness and the same or a lower elongation at break than the material of said textile elements.

In connection with the present invention the term "monofilaments" is used to describe monofilaments consisting of synthetic resin or of metal, i.e., it includes also monofilaments in the form of wires.

In the rope in accordance with the invention the reinforcing elements have a dual function. The relatively hard components disposed on the outside of the rope increase the resistance of the rope to wear so that an abrasion of the remaining elements of the rope in contact with rope pulleys will be prevented or retarded. In a preferred embodiment in which the reinforcing elements constitute a braided or wound covering, which holds the other elements of the yarn together under pressure so that the friction between fibers will be reduced, the separation of impregnating material under alternating bending stresses will be prevented and a separation of fibers during a beending of the rope with small radii or around sharp corners will be opposed. It has been observed that in a rope which is bent around a sharp edge and is ruptured under a tensile load the fibers will rupture in succession. A reinforcement which holds the elements of the rope together under pressure will oppose the rupturing of each fiber and will prevent a contact between the fibers and the edge or pulley around which the rope is bent. The monofilaments are preferably made of nylon, perlon (nylon 6), other polyamides, polyester or metal. If the reinforcement constitutes a braided or wound covering, each monofilament will extend helically around the rope or around the rope element which is to be reinforced and such helix will be highly flexible although it consists of a relatively stiff material.

Within the scope of the invention the rope may be provided with a covering. In that case all or part of the reinforcing elements are embedded in the coating or covering provided on the threads, yarns, ply yarns, or strands or on the core of the rope or on the entire rope so that the coating or covering consisting, e.g., of synthetic resin, such as polyvinylchloride, polyamide, polyester, polyurethane, or of an elastomer, such as rubber, will be reinforced and will be more firmly retained in the rope.

A rope which has a greatly increased life whereas its main properties are preserved will be obtained if the total cross-sectional area of the reinforcing monofilaments is less than 10% or even less than 2% of the cross-sectional area of the rope.

Within the scope of the invention, a rope for safety purposes, such as a climbing rope, may be provided, which comprises a core and a mantle and in which the core consists of parallel or braided ply yarns or twines and the sheath consists of a braided tube. In such a rope, the core is provided with a covering consisting of braided or wound reinforcing monofilaments, which have a diameter which is only a fraction of the thickness of the braided tube.

Furthermore, a hollow braided rope of industrial use may be composed of braided yarns or ply yarns or twines, which may be reinforced by a covering consisting of monofilaments or wires having a diameter which is 1 to 5% of the diameter of the yarn or ply yarn, e.g., a diameter of 0.2 mm.

Within the scope of the invention, a rope may be provided which consists of strands that have been laid, braided or twisted together and are composed of threads, yarns or ply yarns, and in which each of the strands disposed on the outside of the rope contains at least one reinforcing monofilament which takes the place of or is embedded in an external thread or external ply yarn or external yarn or extends along such external threads, ply yarns or yarns. In such a rope, such reinforcing monofilament or the external strand component provided with such monofilament extends on the surface of the rope at least in substantial portions of the length of the rope so that the latter will protected against abrasion.

BRIEF DESCRIPTION OF THE DRAWING

The above and other objects, features and advantages of the present invention will become more readily apparent from the following description, reference being made to the accompanying highly diagrammatic drawing in which:

FIG. 1 is a side elevational view with parts broken away of a rope embodying the present invention;

FIG. 2 is a transverse section through a textile element of such a rope;

FIG. 3 is a view similar to FIG. 2, but drawn to a larger scale, of another textile element;

FIGS. 4 and 5 are elevational views of modifications of FIG. 1; and

FIG. 6 is a transverse section through another textile element embodying the invention.

SPECIFIC DESCRIPTION

The rope in FIG. 1 comprises a core consisting of parallel elongate textile elements 1 consisting of twisted textile fibers in the form of ply yarns or fiber bundles or twines. Said textile elements 1 may be braided or twisted together. The rope also comprises a braided tubular sheath 2 (called mantle), which comprises a plurality of pairs of individual threads arranged in two sets of said pairs. The pairs of said sets are helically wound on the core in mutually opposite senses and the pairs of each of said sets are braided with those of the other set. The rope also comprises a reinforcement consisting of a tubular covering 3 of braided monofilaments surrounding the core, which is composed of the ply yarns 1. Said monofilaments consist of nylon or perlon (nylon 6) or another polyamide or of a polyester or a polyacrylic resin. In the present embodiment each set of pairs of threads of the sheath 2 consists of eight of such pairs so that the sheath will have a checkered pattern, which may be varied by the use of threads in different colors or of threads having length portions in different colors.

FIG. 2 shows a ply yarn 4, which may be used in the core of the rope of FIG. 1 or may be used in one of the ropes which will be described hereinafter with reference to FIGS. 4 and 6 and in that case may be provided with a tubular covering of braided monofilaments 5.

In accordance with FIG. 3 such monofilaments 5 having, e.g., a diameter of 0.2 mm may be embedded in a covering 6 provided on each ply yarn. Such covering may consist of rubber, polyvinylchloride, polyamide or polyurethane.

Like the sheath of the rope shown in FIG. 1, the hollow braided rope shown in FIG. 4 consists of helically wound pairs of ply yarns 7, which are arranged in two sets, each of which comprises a plurality of such pairs. Each of said ply yarns or twines may be designed as shown in FIGS. 2, 3 or 5. FIG. 5 shows a ply yarn 7 provided with a covering consisting of braided helical pairs of monofilaments 8 arranged in two sets.

FIG. 6 shows a strand for use in a relatively thick rope. In that strand, a core ply yarn 9 and external ply yarns 10 consist of the same textile material in the form of twisted staple fibers. One outer ply yarn 11 is a monofilament or is reinforced with a monofilament embedded in its ply yarn. In the complete rope that monofilament or that reinforced ply yarn extends at least in part on the outside surface of the rope to protect the latter from wear.

Monofilaments 12 may be arranged to extend in some or all of the interstices between the external ply yarns 10,11.

I claim:

1. A rope which comprises:

a plurality of elongate textile elements consisting of twisted textile fibers;

an array of reinforcing monofilaments extending throughout the length of the rope and having a higher hardness than said textile elements and an elongation to break which is not in excess of that of said textile elements, surrounding each of said textile elements; and a sheath of braided monofilament surrounding said plurality of elongate textile elements, the total cross sectional area of said reinforcing elements amounting to less than 10% of the total cross sectional area of said rope.

2. The rope defined in claim 1 wherein each of said textile elements is surrounded by a covering of a material selected from the group which consists of rubber, polyvinylchloride, polyamide, and polyurethane in which said reinforcing elements are embedded.

3. The rope defined in claim 1 wherein said reinforcing elements of each array are formed as a braid around the respective textile element.

4. The rope defined in claim 1 wherein the reinforcing elements of each array are wound about the respective textile element surrounded by said array.

5. The rope defined in claim 1 wherein the total cross sectional area of said reinforcing elements amounts to less than 2% of the total cross sectional area of said rope.

6. The rope defined in claim 1 wherein said reinforcing elements are smaller in thickness than said textile elements.

7. The rope defined in claim 1 wherein said textile elements consist of ply yarns.

8. The rope defined in claim 1 wherein said textile elements are braided together.

* * * * *